United States Patent [19]

Adams

[11] Patent Number: 4,694,662

[45] Date of Patent: Sep. 22, 1987

[54] CONDENSING SUB-COOLER FOR REFRIGERATION SYSTEMS

[76] Inventor: Robert W. Adams, P.O. Box 68,Norway, Mich. 49870

[21] Appl. No.: 901,962

[22] Filed: Aug. 26, 1986

Related U.S. Application Data

[63] Continuation of Ser. No. 665,916, Oct. 29, 1984, abandoned.

[51] Int. Cl.[4] ..... F25B 39/04

[52] U.S. Cl. ..... 62/509; 62/513

[58] Field of Search ..... 62/509, 512, 513; 159/3, 4.01

[56] References Cited

U.S. PATENT DOCUMENTS

| | | | |
|---|---|---|---|
| 997,430 | 7/1911 | Whittlesey | 159/4.01 |
| 2,183,346 | 12/1939 | Buchanan | 62/3 |
| 2,489,680 | 11/1949 | Shoemaker et al. | 62/115 |
| 2,518,587 | 8/1950 | Zearfoss | 62/8 |
| 2,885,868 | 5/1959 | Radcliffe | 62/509 |
| 2,897,659 | 8/1959 | Werener | 62/509 |
| 3,163,998 | 1/1965 | Wile et al. | 62/512 |
| 3,310,103 | 3/1967 | Osborne | 62/512 |
| 3,481,151 | 12/1969 | Seeley | 62/512 |
| 3,553,974 | 1/1971 | Osborne | 62/512 |
| 4,142,381 | 3/1979 | Lavigne, Jr. | 62/510 |
| 4,207,749 | 6/1980 | Lavigne, Jr. | 62/115 |
| 4,259,848 | 4/1981 | Voight | 62/113 |

FOREIGN PATENT DOCUMENTS 2526137 5/1983 France .

*Primary Examiner*—Ronald C. Capossela
*Attorney, Agent, or Firm*—Arnold, White & Durkee

[57] ABSTRACT

A fixed, mechanical condenser sub-cooler for a refrigeration system which increases the efficiency of the system is provided. The sub-cooler includes a shell defining a chamber having a spray bar mounted therein through which high pressure liquid refrigerant is passed such that its pressure is reduced so as to cool the liquid refrigerant. The sub-cooler is positioned in the high pressure liquid line prior to a metering device such as an expansion valve.

12 Claims, 5 Drawing Figures

CONDENSING SUB-COOLER FOR REFRIGERATION SYSTEMS

This is a continuation of co-pending application Ser. No. 665,916 filed on Oct. 29, 1984, now abandoned.

BACKGROUND OF THE INVENTION

The present invention relates to closed circuit refrigeration systems having a metering device such as an expansion valve, a condenser, a compressor, and an evaporator. More particularly, the invention relates to a sub-cooler for a refrigeration system which cools the liquid and condenses vapor in the liquid line prior to the liquids passing through the metering device.

Refrigeration systems consume a significant portion of all electrical energy generated in the United States. Because the systems have to operate at different ambient temperatures, they seldom operate at the most efficient level. Accordingly, a substantial amount of energy is wasted.

One problem which causes a portion of this inefficiency is the formation of vapor in the liquid refrigerant line between the condenser and the metering device. In many systems, there is a long piece of tubing between the condenser and the metering device. As the liquid refrigerant passes through this tubing it can absorb heat if the ambient temperature is high, causing vapor to form. Additionally, pressure reductions in the line as a result of friction or decreases in the head pressure as the refrigerant moves further from the compressor and condenser can contribute to the formation of vapor. Because the metering devices generally are sized for passing only liquid, any vapor in the line significantly decreases the efficiency of the system by decreasing the amount of liquid which can pass through the metering device to the evaporator.

Various approaches procedures have been developed and utilized to overcome the problem of vapor formation. One approach involves increasing the pressure in the liquid refrigerant line to a point that no vapor will form under most or all operating conditions which the system is likely to encounter. However, this requires a larger compressor than would otherwise be necessary, resulting in a greater use of power to run the compressor.

Another approach is disclosed in U.S. Pat. No. 4,259,848 to Voigt. In this system, vapor formed by exposure of the liquid refrigerant conduit to ambient conditions is withdrawn from a receiver by a dual suction compressor, and the refrigerant approaching the expansion valve is adiabatically cooled in a heat exchanger to liquefy any additional vapor formed by the withdrawal of vaporized refrigerant from the high pressure portion of the circuit. While this system works under some circumstances, it still has several drawbacks. For example, it cannot be used effectively on refrigeration systems utilizing a hot gas defrost. Additionally, a complicated valving mechanism between the receiver and the compressor is required to control the flow of vaporized refrigerant from the high pressure line back to the compressor. Also, the metering device in such a system must be an expansion valve.

Accordingly, it would be a significant advancement in the art to provide a fixed, mechanical condensing sub-cooler which could be used in closed circuit refrigeration systems to cool the liquid refrigerant and to condense vapor formed in the high pressure liquid line before it passes through the metering device. It would be particularly advantageous to provide such a system which is simple in construction and operation, and which is effective. Such a system is disclosed and claimed herein.

BRIEF SUMMARY OF THE INVENTION

The present invention provides a fixed, mechanical condensing sub-cooler for condensing vaporized refrigerant and for sub-cooling the liquid prior to its entering a metering device such as an expansion valve in a closed-circuit refrigeration system. The sub-cooler comprises a shell forming a chamber having an inlet and an outlet and is placed in the liquid refrigeration line immediately preceding the metering device in the direction of flow. The inlet includes means for reducing the pressure of the liquid refrigerant so as to effectuate cooling which causes any vapor present in the system to condense. In a preferred embodiment, the pressure reducing means comprises a length of tubing attached to the inlet to the shell, said tubing including a plurality of orifices through which refrigerant is discharged into the chamber in the shell. A liquid level is maintained within the sub-cooler and the outlet is connected below the level of the liquid such that vapor is not passed through the outlet to the metering device.

Inasmuch as the present invention condenses any vapor which is formed in the liquid refrigerant line immediately prior to the liquids entering the metering device, a reduced refrigerant charge can be used which permits the system to be operated below the standard design temperature and pressure such that a given quantity of refrigerant will have a greater cooling effect as it passes through the evaporator. Accordingly, systems utilizing the present invention can provide the same amount of cooling with less power consumption than conventional systems.

DETAILED DESCRIPTION OF THE PREFERRED EMBODIMENTS

The present invention is directed to a fixed, mechanical condenser sub-cooler for closed circuit refrigeration systems. The sub-cooler is placed in the liquid refrigerant line immediately prior to the metering device, which can be a conventional expansion valve or capillary tube system. The sub-cooler cools the liquid refrigerant prior to its entering the metering device so as to increase the efficiency of the system, and condenses vapor formed in the liquid line through absorption of ambient heat along the length of the liquid line caused by a reduction in the pressure head between the condenser and metering device.

Figure 3:
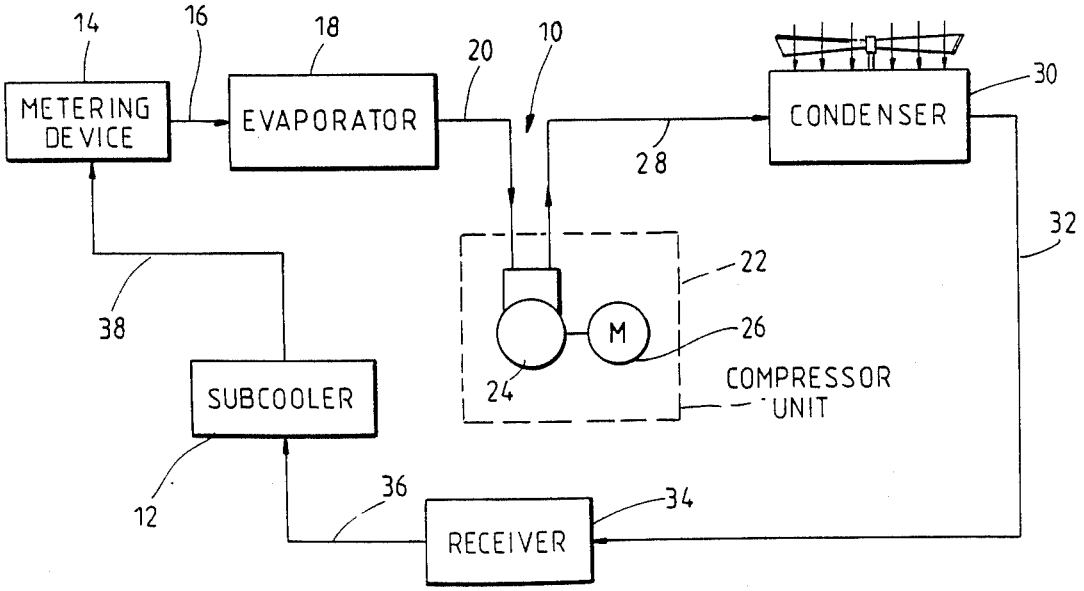
FIG. 3 is a schematic view of a refrigeration circuit including the present invention.

Reference is first made to FIG. 3 which schematically illustrates a conventional refrigeration system, generally designated at 10, into which a sub-cooler 12 of the present invention has been incorporated.

Refrigeration system 10 includes a metering device 14 which can be an expansion valve, capillary tube, or any other type of conventional metering device used in refrigeration circuits. A low pressure liquid line 16 extends from metering device 14 to evaporator 18 where the refrigerant is allowed to vaporize and absorb heat. From the evaporator, the vaporized refrigerant passes through line 20 to compressor unit 22. Compressor unit 22 comprises a compressor 24 which is powered by a motor 26. Either centrifugal or positive displacement compressor units can be utilized in circuits incorporating the present invention.

From the compressor unit, high pressure vaporized refrigerant is passed through line 28 to a condenser 30 in which the refrigerant is condensed. While condenser 30 is illustrated as an air cooled condenser, it will be appreciated that the system can also utilize water cooled units or any other type of conventional condenser.

From the condenser, the liquefied refrigerant passes through line 32 to a receiver 34. As will be more fully discussed hereinafter, when utilizing the present invention it is possible to eliminate receiver 34 from the refrigeration system.

From receiver 34, the liquefied refrigerant passes through line 36 to sub-cooler 12. Any vapor which is formed as the refrigerant passes through lines 32 and 36 is condensed in sub-cooler 12 before the refrigerant passes to metering device 14.

Figure 1:
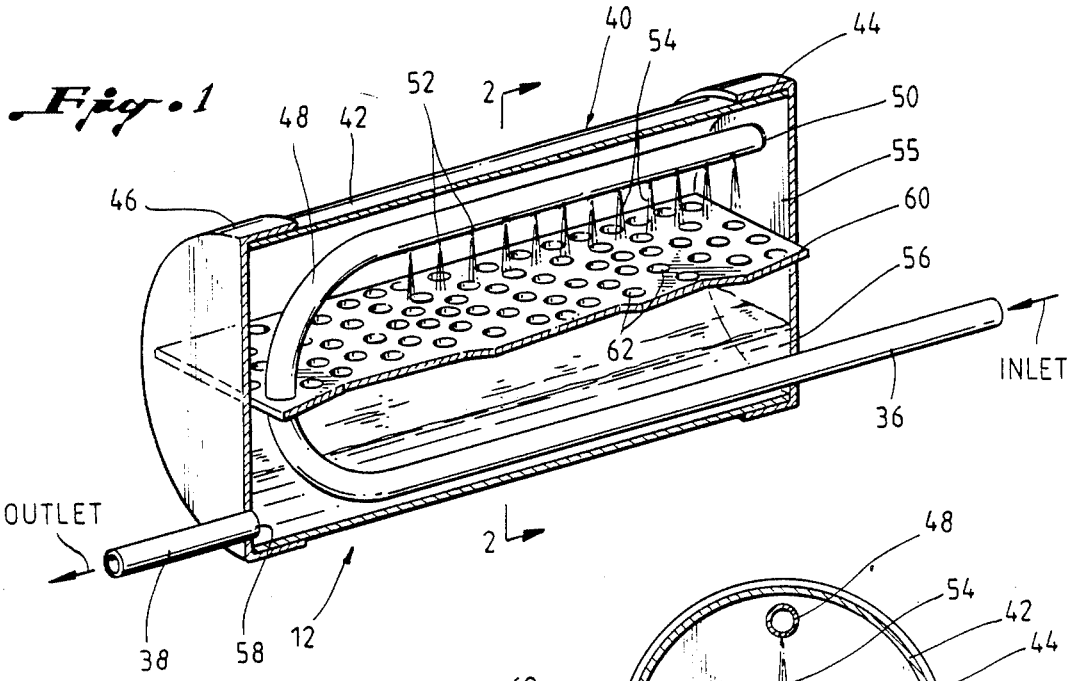
FIG. 1 is a cross-sectional view of a preferred embodiment of the sub-cooler of the present invention mounted in a horizontal position.

Reference is next made to FIG. 1, in which a preferred embodiment of sub-cooler 12 is illustrated in a cross-sectional view. Sub-cooler 12 includes a shell 40 having an inlet connected to line 36 coming from the receiver or condenser and an outlet connected to the line 38 leading to the metering device. In the illustrated embodiment, shell 40 is formed from a cylindrical tube 42 having end caps 44 and 46. Shell 40 defines a chamber which is partially filled with liquid refrigerant such that there is a liquid level 56 and a vapor space 55.

In the illustrated embodiment, a portion of line 36 extends into shell 40 and is bent into a U-shaped configuration to form a spray bar 48 which is positioned in vapor space 55. The end of spray bar 48 includes a cap or plug 50. A plurality of orifices 52 are formed along a portion of the length of spray bar 48 to act as nozzles. As the liquid refrigerant 54 sprays out of orifices 52 its pressure is reduced which creates a cooling effect. This cooling causes vapor in the line to condense.

The liquid refrigerant 56 in the bottom of sub-cooler 12 is withdrawn through outlet 58 into line 38 where it passes to the metering device. If sub-cooler 12 is properly sized, receiver 34 (see FIG. 3) can be eliminated from the refrigeration circuit and the chamber formed by shell 40 of sub-cooler 12 can serve as the receiver.

In the illustrated embodiment, a plate 60 is positioned within shell 48 between spray bar 48 and the liquid 56. Plate 60 includes a plurality of orifices 62 through which the liquid refrigerant can pass. Plate 60 serves to avoid splashing of the liquid 56 which might be caused by the spray 54. However, plate 60 is not essential to the operation of sub-cooler 12 and can be eliminated if desired.

The number and size of the orifices 52 in spray bar 48 are adjusted such that a pressure drop of from about 3 to about 6 pounds per square inch is created across sub-cooler 12. The preferred pressure drop is about 5 pounds per square inch when using a refrigerant such as 12, 22, 500, 502, or F-11. This pressure drop has been found to be sufficient to condense any vapor formed in the liquid line. Because vapor is condensed and only liquid refrigerant is withdrawn from sub-cooler 12 it is possible to reduce the refrigerant charge and thus the operating pressure and temperature of the refrigeration system. This allows a given volume of refrigerant to have a greater cooling effect as it passes through the evaporator downstream from the metering device. Accordingly, the refrigeration system is more efficient and less power is required to provide the same cooling effect.

Figure 2:
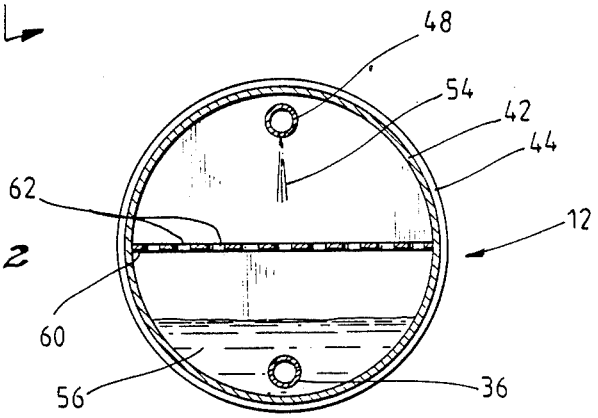
FIG. 2 is a cross-sectional view of the embodiment illustrated in FIG. 1 taken along the line 2—2.
Figure 4:
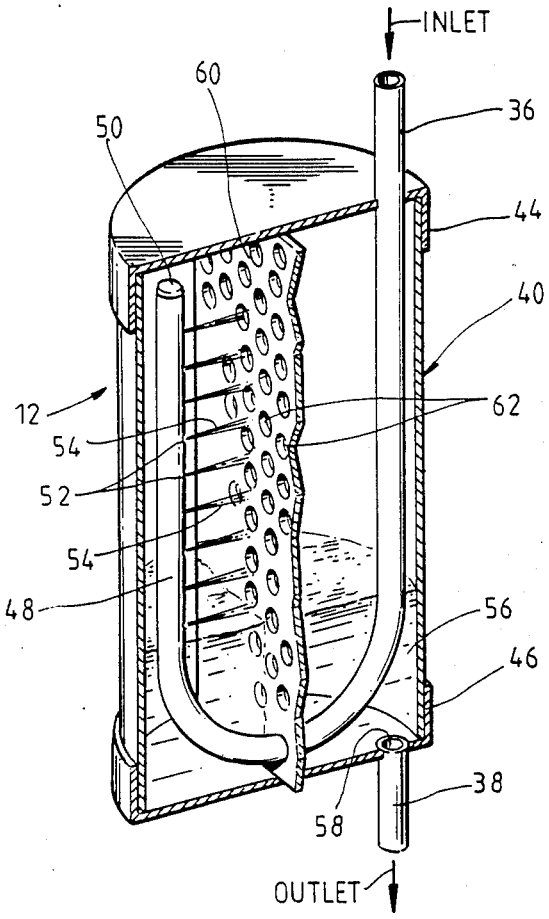
FIG. 4 is a cross-sectional view of the embodiment illustrated in FIG. 1 mounted in a vertical position.

Reference is next made to FIG. 4 which illustrates the embodiment of FIGS. 1 and 2 as it would operate if installed in a vertical position. The inlet line 36 is arranged to enter the top of shell 40 and the outlet 58 is positioned in the bottom of shell 40. The level of the liquid 56 is generally adjusted such that it is below the orifices 52. Should the liquid level rise so as to cover the bottom most of orifices 52, the sub-cooler will still operate but its cooling capacity will be reduced.

Figure 5:
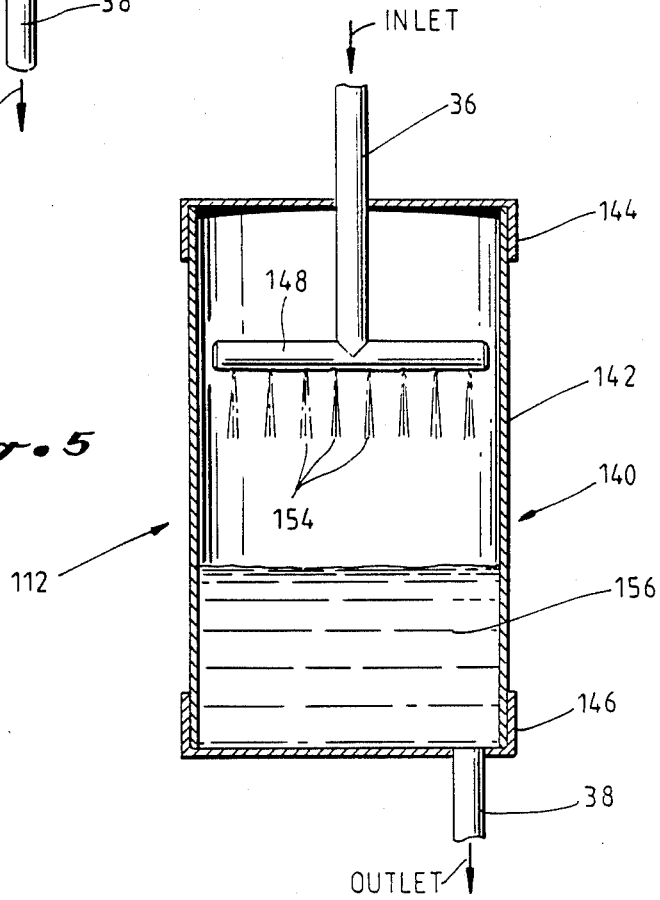
FIG. 5 is a cross-sectional view of a second preferred embodiment of the present invention.

Referring now to FIG. 5, a second preferred embodiment of the present invention is illustrated in cross section. Sub-cooler 112 includes a shell 140 which is formed from a piece of cylindrical tubing 142 with end caps 144 and 146. Line 36 passes through upper end cap 144 and is connected to a spray bar 148 by a T-connection. Spray bar 148 includes a plurality of orifices 152 through which liquid refrigerant 154 is sprayed.

Liquid refrigerant 156 is maintained at a level in the bottom of shell 140 and is removed through line 38.

As can be seen from the foregoing, the present invention provides a novel fixed, mechanical condenser which can be added into substantially any refrigeration system to reduce its normal power requirements. The sub-cooler provides for the condensation of any vapor which may form in the line leading from the condenser to the metering device such that a reduced refrigerant charge can be used.

While the invention has been described with respect to the presently preferred embodiments, it will be appreciated that other modifications or changes could be made without departing from its scope or essential characteristics. For example, in the embodiment illustrated in FIG. 5 a plurality of spray bars could be used or the spray bar could be configurated as a disk with a plurality of orifices. Changes could also be made to the shape of the shell of the sub-cooler. Additionally, the system can be operated with or without a plate between the spray bar and the surface of the liquid refrigerant. Accordingly, all changes or modifications which come within the meaning and range of equivalency of the claims are to be embraced within their scope.

I claim:

1. A closed circuit, liquid refrigeration system comprising:

a liquid metering device for reducing the pressure of a liquid refrigerant;

an evaporator;

a compressor;

a condenser; and a mechanical sub-cooler adjacent said metering device for condensing any vapor in said liquid refrigerant prior to said liquid refrigerant entering into said metering device, said sub-cooler consisting essentially of:

a shell defining a chamber having an inlet and an outlet; and pressure reducing means connected to said inlet within said shell for receiving high pressure liquid refrigerant and reducing the pressure of liquid refrigerant passing therethrough.

2. A closed circuit, liquid refrigeration system as defined in claim 1, wherein said metering device comprises an expansion valve.

3. A closed circuit, liquid refrigeration system as defined in claim 1, wherein said pressure reducing means comprises a spray bar having an orifice through which liquid refrigerant is discharged under pressure.

4. A closed circuit, liquid refrigeration system as defined in claim 1, wherein said spray bar contains a plurality of orifices.

5. A closed circuit, liquid refrigeration system as defined in claim 1, wherein said sub-cooler further includes a plate between said spray bar and a level of liquid refrigerant in said chamber of said sub-cooler.

6. A method of reducing the energy requirements of a closed circuit, liquid refrigeration system having a metering device, an evaporator, a compressor, a condenser, and a reduced liquid refrigerant charge, said method comprising the steps of:

passing high pressure liquid refrigerant into a mechanical sub-cooler prior to its entering the metering device, said sub-cooler consisting essentially of a shell defining a chamber having an inlet and an outlet, and a pressure reducing means connected to said inlet within said shell for receiving high pressure liquid refrigerant and reducing the pressure of liquid refrigerant passing therethrough;

reducing the pressure of said liquid refrigerant in said mechanical sub-cooler sufficiently to condense any vapor in the entering refrigerant and to cool the entering refrigerant; and passing the reduced pressure liquid refrigerant from the mechanical sub-cooler to the metering device.

7. A condenser subcooler to be positioned adjacent a liquid metering device in a closed circuit refrigeration system consisting essentially of:

a shell defining a chamber having an inlet and an outlet; and a pressure reducing means connected to said inlet for receiving high pressure liquid refrigerant and reducing the pressure of said liquid refrigerant passing therethrough.

8. A condenser subcooler for a refrigeration system as defined in claim 7, wherein said pressure reducing means comprises a spray bar having a plurality of orifices formed therein.

9. A condenser subcooler for a refrigeration system as defined in claim 8, wherein the number and size of said orifices are effective to create a pressure drop of from about 3 to about 6 pounds per square inch across said subcooler.

10. A condenser subcooler for a refrigeration system as defined in claim 9, wherein the number and size of said orifices are effective to create a pressure drop of about 5 pounds per square inch across said subcooler.

11. A condenser subcooler for a refrigeration system as defined in claim 7, wherein said subcooler is positioned in the high pressure liquid refrigerant line upstream from a metering device and wherein said shell is arranged in a vertical position.

12. A condenser subcooler for refrigeration system as defined in claim 7, wherein said subcooler is positioned in the high pressure liquid refrigerant line upstream from a metering device and wherein said shell is arranged in a horizontal position.

* * * * *